United States Patent [19]

Anderson

[11] Patent Number: 4,616,548

[45] Date of Patent: Oct. 14, 1986

[54] GUITAR COMPOSED OF HIGH STRENGTH-TO-WEIGHT RATIO MATERIAL

[76] Inventor: Arndt S. Anderson, 9500 Oso St., Chatsworth, Calif. 91311

[21] Appl. No.: 593,695

[22] Filed: Mar. 26, 1984

[51] Int. Cl.[4] ..... G10H 3/18

[52] U.S. Cl. ..... 84/1.16; 84/DIG. 30

[58] Field of Search ..... 84/1.14–1.16, 84/267, DIG. 30

[56] References Cited

U.S. PATENT DOCUMENTS 3,769,871 11/1973 Cawthorn ..... 84/1.16 X 4,201,108 5/1980 Bunker ..... 84/1.16

*Primary Examiner*—Stanley J. Witkowski

*Attorney, Agent, or Firm*—Roger A. Marrs

[57] ABSTRACT

A stringed guitar is disclosed herein having a body and fret board composed of metal in the form of an integral or unitary construction incorporating accurate fret spacing and capable of being cast for production including the ability of being plated. Musical characteristics are enhanced by the metallic composition due to the greater density than other materials so that increased particle movement within the composition of the fret board and the body produce different transverse and longitudinal sound wave patterns.

11 Claims, 4 Drawing Figures

2
14
16
15
10
12
13
41
42
33
22
11
21
26
34
23
35
24
31
25
32
23
28
24
27
18
19
17
30
36
37
2

14
16
15
10
12
39
38
25
44
11
27
26
37
AMPLIFIER 12
41
13
42
40
38
38
11
A 14
15
16
10
13
12
11
21
26
25
23
27
24
19
18
17
37

GUITAR COMPOSED OF HIGH STRENGTH-TO-WEIGHT RATIO MATERIAL

BACKGROUND OF THE INVENTION

1. Field of the Invention

The present invention relates to stringed instruments and, more particularly, to a novel guitar composed of a high strength-to-weight ratio material such as metal that not only improves the musical characteristics produced by the instrument but permits the user to more easily hold and manipulate the instrument during a performance.

2. Brief Description of the Prior Art

It has been the conventional practice to manufacture stringed instruments such as guitars from common materials such as wood and plastic. The guitar includes a body provided with a resonance means and an elongated fret board having a plurality of fret locations arranged in fixed spaced apart relationship. The strings of the instrument are stretched across the body and fret board and anchored at their opposite ends so as to be tensioned whereby plucking of the strings causes vibrations thereof to pass into the body and fret board producing a variety of overtone resonant frequencies.

Musical characteristics produced by the instrument are largely dictated by the accuracy by which the fret bars are carried on the fret board in accurately spaced apart relationship, the shape, depth and relationship of the resonating means with respect to the overlying strings and the particle movement of the instrument composition caused by vibration induced by the plucking of the strings. Furthermore, the composition of the body and the fret board is extremely important in producing sustained sound. Furthermore, although construction material such as wood and plastic are considered to be light weight, considerable thicknesses and mass must be utilized in order to provide sufficient density and particle movement to obtain desirable musical characteristics. Thus, such stringed instruments are large, bulky and cumbersome to use during a performance on stage.

Therefore, a long standing need has existed to provide a novel stringed instrument which has improved musical characteristics particularly with respect to the length of time that the strings and body vibrate as well as providing improved or increased resonation and true tone. The improved instrument is to be of light weight construction and of lesser physical dimension than is conventionally used so that the instrument may be readily carried and manipulated by the performer on the playing platform with ease and freedom.

SUMMARY OF THE INVENTION

Accordingly, the above problems and difficulties are obviated by the present invention which provides a novel stringed instrument in the form of a guitar having a body and a fret board composed of metal integrally joined at opposing ends to provide a unitary construction and having strings carried along the length of the instrument so as to induce vibrations into the fret board and body when plucked by a musician. The metal composition is of a high strength-to-weight material such as magnesium providing lightness in weight and providing substantial particle and molecular density whereby induced vibrations create transverse and longitudinal sound wave patterns enhancing the musical characteristics produced by the instrument. The fret board and body are of reduced thickness with the body and fret board combined thickness being less tnan one inch.

Therefore, it is among the primary objects of the present invention to provide a novel stringed instrument having improved musical characteristics in terms of loudness, pitch and quality due to the density of molecular composition of the material used resultant particle movement produced by induced vibrations from the strings of the instrument.

Another object of the present invention is to provide a novel stringed instrument such as a guitar having its body and fret board composed of a high strength-to-weight ratio material such as metal and, more particularly magnesium, which permits the fabrication of a light weight instrument of lesser size and dimension than can ordinarily be achieved with instruments constructed from wood or plastic and which provides greater resonance and sound sustension.

Yet another object of the present invention is to provide a novel guitar having a body and fret board composed of light weight metal that permits accurate spacing of fret bars within specified tolerance.

Still a further object of the present invention is to provide a novel guitar composed of a high strength-to-weight ratio metal such as magnesium that provides high density molecular and particle arrangement whereby total thickness of combined body and fret board is no more than one inch.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENT

Figure 1:
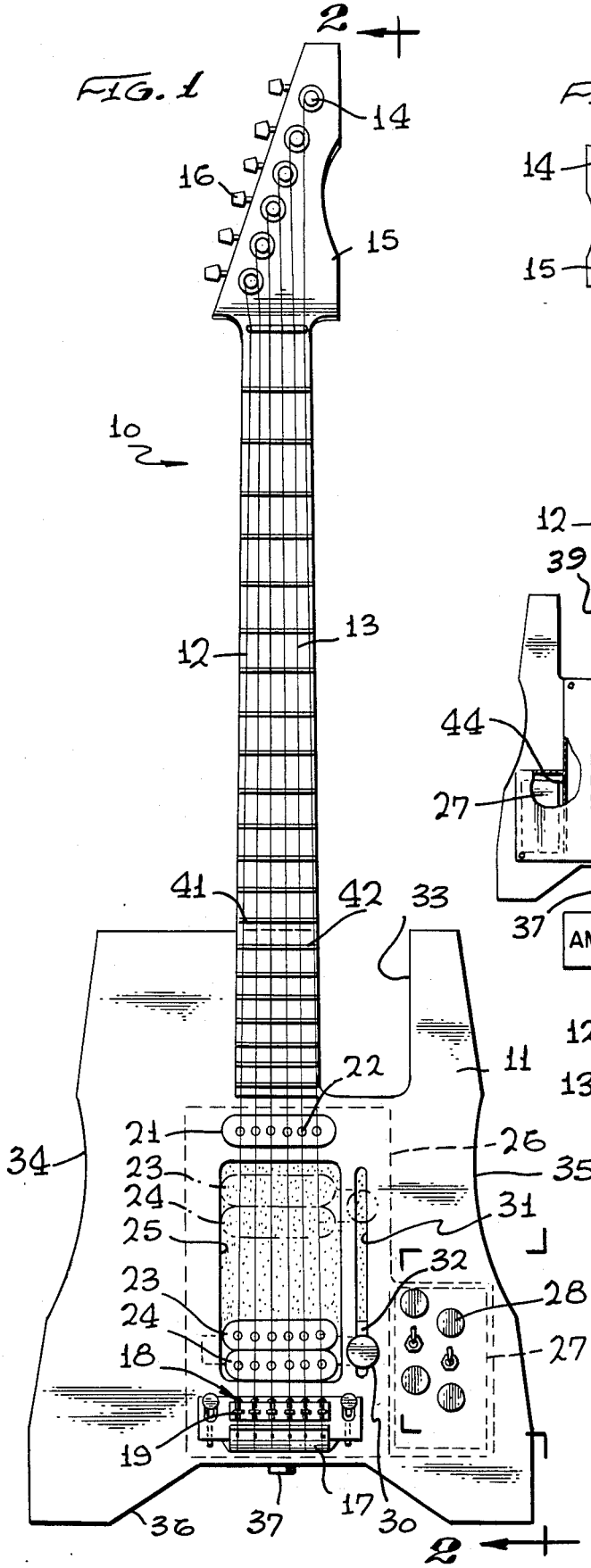
FIG. 1 is a front elevational view of a stringed guitar incorporating the present invention.

Referring to FIG. 1, the novel stringed instrument of the present invention takes the form of a stringed guitar indicated in the general direction of arrow 10. The guitar includes a body 11 and an elongated fret board 12 having one end thereof coupled to the edge marginal region of the body 11. A plurality of strings, such as string 13, is tensioned between anchoring points established at the opposite ends of the string by means of anchor pins 14 carried on the head stock 15 which are operably coupled to tuning pegs 16 for regulating the tension of the respective strings. The opposite ends of the strings are fixed to a slotted retainer 17 after passing over a bridge 18 carrying individual saddles 19 for the respective strings such as string 13. A stationary block 21 carries a plurality of electronic pickups in a row in spaced apart relationship. The electronic pickup associated with string 13 is identified by numeral 22. A pair of movable pickup blocks 23 and 24 are arranged to move a limited distance beneath the plurality of strings and each of the movable blocks carry a plurality of electronic pickup in contact with each of the respective strings. The pickups on each block are arranged in a row in spaced relationship and the pickups carried on blocks 23 and 24 are also in alignment with each other beneath an associated string of the plurality.

It is to be noted that a central opening or cutout identified by numeral 25 is provided in the body 11 beneath the plurality of strings and established between the row of fixed pickups on pickup block 21 and the bridge 18. The opening 25 is provided all the way through the body 11 and is closed by the bottom of an electronics box indicated in general by the numeral 26. Carried on the electronic box 26, there is provided an electronic package indicated in general by the numeral 27 which includes a plurality of electronic component parts mounted on circuit boards and the like which are operably connected to the multiplicity of pickups included on the stationary block 21 and the movable blocks 23 and 24. Also operably connected to the electronic package components, there is provided a plurality of switches and knobs for controlling ON/OFF functions, volume controls, tone control and the like. A typical control knob is indicated by numeral 28. Additionally, the body 11 mounts a sliding knob 30 which moves through an elongated slot 31. The end of the knob 30 is connected to a sliding plate 32 on which the movable blocks 23 and 24 are mounted so that the blocks can be selectively disposed anywhere along the length of the opening 25 beneath the strings as desired.

The body 11 is further formed with an open ended cut-out 33 at the front end of the body and adjacent to one side of the neck or fret board 12 which is intended to accommodate the hand of the musician during the playing of the instrument. Also, lateral cut-outs 34 and 35 are included which are intended to conform to various parts of the performer's body during the support of the instrument on the leg, hip or side of the musician. A lightening cut-out 36 is provided which in combination with the above mentioned cut-out serve to lighten the weight of the instrument which permits additional freedom by the musician to use the instrument. A receptacle for a jack is indicated by numeral 37 which is intended to couple the electronic package 27 with a remote amplifier.

Figure 2A:
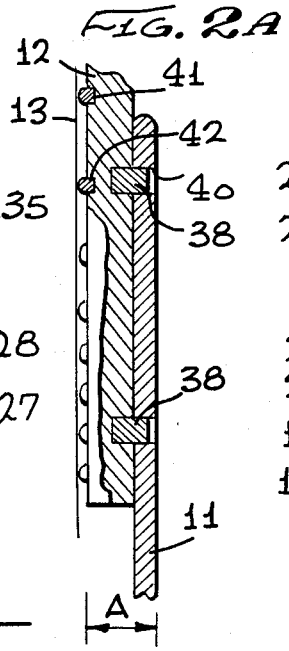
FIG. 2A is an enlarged sectional view of the fret board-to-body connection.
Figure 2:
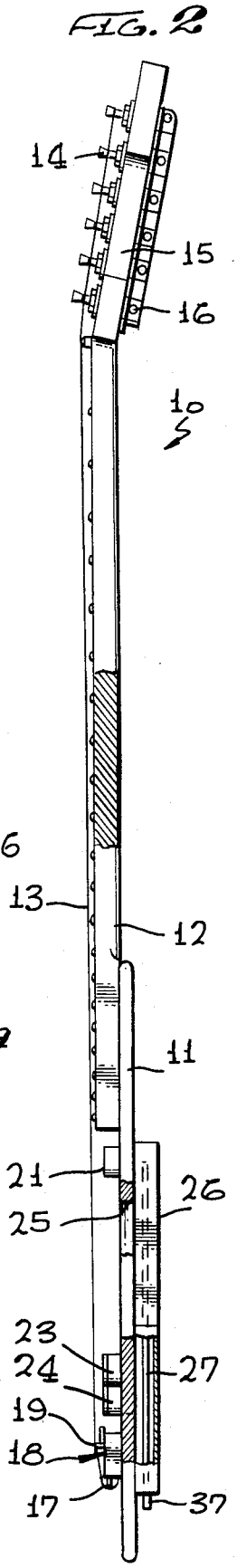
FIG. 2 is a longitudinal sectional view of the guitar shown in FIG. 1 taken in the direction of arrows 2—2 illustrating the reduced thickness and metallic composition of the body and fret board.

Referring now in detail to FIG. 2, it can be seen that the composition of the body 11 and the fret board 12 are composed of a metal and, preferably, the metal is magnesium which is characterized as being a high strength-to-weight ratio material. Because of this characteristic, the metal is of high density and is of a much greater density than conventional materials such as wood or plastic. The underside of body 11 carries the electronic box or enclosure 26 which is suitably attached to the body by means of screws. The bottom of the box 26 closes the opening 25 which is provided in the body 11 and cooperates therewith to provide a resonating means which greatly enhances the sound from the instrument. In general, the opening in combination with the enclosure or case 26 may be referred to as a "hollow pocket" that provides increased resonation.

The overall sound of the instrument is greatly improved because of the integral joining of the neck or fret board with the body 11 in a unitary construction as shown in FIG. 2A. The end of the fret board 12 is formed with holes into which a plurality of pegs, such as peg 38, is attached by press fit. Next, the body 11 is provided with a plurality of corresponding holes, such as hole 40, into which the pressed pin or dowel 38 is placed in an interference fit. By employing an interference fit, it is possible to subsequently remove the body from the fret board for service and maintenance purposes. The dowel-pinning of the fret board to the body greatly sustains the length of time that the string and body vibrate. The more rigid the neck and body connection, the longer string vibration will last. Furthermore, because of the high density metal material forming the composition of the neck and body, the combined thickness of the neck and body is no greater than one inch which is the dimension indicated by the letter A. Preferably, the thickness of the body is three-eighths of an inch while the thickness of the neck or fret board is five-eighths of an inch.

FIG. 2A also shows frets for fret bars 41 and 42 which are strips of metal that are embedded into precisely and accurately machined grooves formed in the exposed surface of the fret board 12. A feature of the invention resides in the accurate machining of the grooves for accepting the fret bars to a critical dimension of 0.0005 inch. When materials other than metal are used such as wood or plastic, such high accuracy and tolerance cannot be attained. The ultimate sound characteristics of the instrument are dependent on special formulas for critically spacing the fret bars in fixed relationship along the length of the fret board. As illustrated, the distance between adjacent fret bars along the length of the board decreases as the fret bars are placed closer to the body 11 from the head stock 15. Although selected formulas are optional, the fact remains that the placement of each fret bar in a specific groove in the fret board is critical and requires accurate placement.

Figure 3:
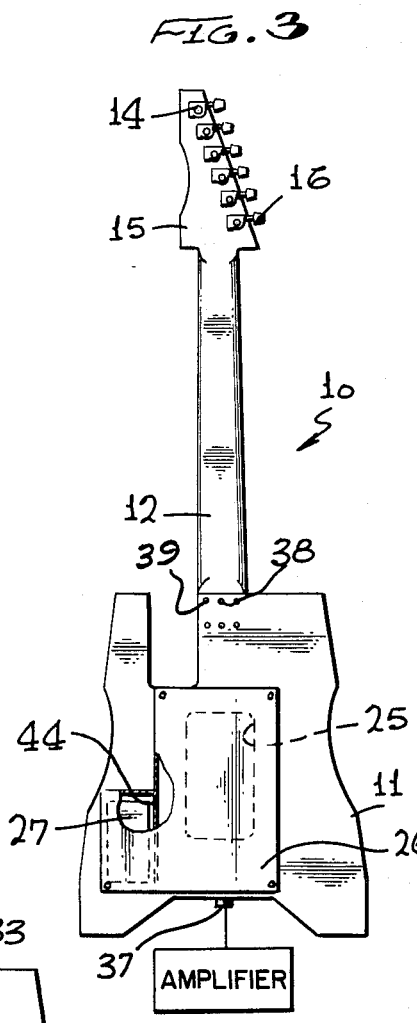
FIG. 3 is a reduced rear elevational view of the guitar shown in FIG. 1 illustrating the arrangement of the electronic package and the integral connection of the fret board with the body.

Referring now in detail to FIG. 3, it can be seen that the case 26 is attached to the rear surface of the body 11 and that the case 26 encompasses the opening 25 provided in the body. The case also encloses the electronic package 27 and includes a barrier or wall isolating the package 27 from the resonant means comprising the opening 25 and the bottom and sides of the case 26. The wall or barrier is indicated by the numeral 44. Also, the dowel pinning of the fret board 12 to the body 11 is illustrated wherein the dowels are arranged between removable bolts 39 to provide an integral connection. The press fitting of the pin or dowel into the fret board 12 provide a permanent connection therebetween while the slip fit between the dowel and the openings in the body 11 are secure to be fixed so as to achieve an integral connection; however, the slip fit does provide for disconnection should the occasion require replacement, maintenance or repair. Security bolts 39 are easily removed for disassembly of the fret board from the body.

Therefore, in view of the foregoing, it can be seen that the metallic composition of the fret board and body give rise to the construction of these components by casting procedures which lend it to efficiency and high production. By employing metal components, not only can these components be plated but accurate cuts can be achieved such as the grooving along the flat surface of the fret board for the subsequent mounting of fret bars in precise fixed spaced apart relationship. The use of metal, particularly magnesium, gives rise to a high strength-to-weight ratio composition permitting increased density of the material over materials such as plastic and wood. The increased density of metal being greater than wood or plastic permits sound waves to travel more faithfully with less resistance through the fret board and the body. By rigidly attaching the end of the fret broad to the body, the length of time in which the string and body vibrate is greatly extended. In other words, the more rigid the neck and body are connected such as by the pin or dowel arrangement, the longer string vibrations will last. Augmenting this advantage is the hollow pocket which greatly increases the resonation. The direct sound waves produced by plucking of the strings is reinforced by the reflected sound waves within the hollow pocket or cavity defined by the opening 25 and the enclosure of the case 26 with the underside of the body 11. The employment of metal for the body and neck or fret board permits forced vibration to occur which increases loudness that results from the neck compelling the body to vibrate with a frequency of its own. The high density of the metal provides for closer particle compaction whereby particle movement within the metal composition creates different patterns of transverse waves and longitudinal waves through the metal. Traditionally, a transverse wave is one that causes the particles of a medium to vibrate at right angles to the direction in which the wave is moving. A longitudinal wave is one that causes the particles of a medium to vibrate parallel to the direction in which the wave is moving. A sounding body such as the neck and body 11 produce longitudinal waves in the air or in some other medium around it. As the body moves back and forth in accordance with the vibrations, the number of condensations and rarefactions produced per second is equal to the frequency of the movement. The chain of alternate condensations and rarefactions constitute the sound waves emitted by the body and to some extent the neck or fret board.

As referred to above, the use of metal permits overall thinness or reduced thickness for both the neck or fret board and the body. The overall thickness can be maintained within a maximum dimension of one inch when combined or within the dimensions of three-eighths of an inch for the body and five-eighths of an inch for the neck.

It is also to be undertood that a massive ground is set up around the electronic pickups. The pickups are generally small coils of wire wrapped around steel slugs or magnets which create an inductive force field immediately adjacent to the strings. One side of each coil is grounded to the body while the guitar body is grounded to the amplifier via the plug 37. In conventional electronic guitars, the coils are grounded to the electronics within the package in the box and coupled directly to the amplifier. This is necessary in conventional guitars since the wood or plastic bodies are not electrically conductive and are, to the contrary, insulative. Therefore, a major advancement in the field is made by providing the sound board of an instument such as the body and fret board of a guitar from a light weight, high density material such as a metal which includes magnesium.

The slip fit of the dowel or pin connection between the fret board and body and removable bolts permits interchangeability of bodies whereby bodies of different configuration may be substituted at the selection of the musician.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An electronic stringed musical instrument comprising:

an instrument body having a fret board outwardly projecting from an edge marginal region of said body;

a plurality of strings extended across said body and fret board having opposite ends of said strings fixed to said body and the free end of said fret board;

electronic pick-up means carried on said body in close proximity to said strings for sensing vibrations thereof and generating electrical signals in response thereto; and said body composed of an electrically conductive material operably coupled to said electric pick-up means constituting a massive ground therefor.

2. The invention as defined in claim 1 wherein:

said electrically conductive material is of a metallic high strength-to-weight composition of greater density than wood or plastic so that increased particle movement within the composition of said body produces substantially different transverse and longitudinal sound wave patterns.

3. The invention as defined in claim 2 wherein:

said body is provided with a central opening immediately adjacent to said strings;

a metallic box mounted on said body on its side opposite to the side adjacent said strings surrounding said body opening; and said body, said body opening and said metallic box comprising a hollow pocket increasing resonation.

4. The invention as defined in claim 3 including:

means detachably connecting said fret board to said body so as to provide a rigid and integral connection therebetween for sustaining the vibrations induced by said strings.

5. The invention as defined in claim 4 wherein:

said connection means are a plurality of steel dowels interconnecting said fret board with said body.

6. An electronic stringed instrument comprising:

an integral and unitized structure having a body and at least one fret board outwardly extending from one end of said body;

a plurality of strings extended across said structure having opposite ends of said strings anchored to opposite ends of said structure respectively;

said structure characterized as composed of a high strength-to-weight ratio material of high molecular density greater than that of wood and plastic whereby transverse and longitudinal wave patterns affect particle movement within said material producing sound characteristics different from that of wood and plastic;

a plurality of electronic pick-ups carried on said structure body in close proximity to said strings;

an electronic amplifying means coupled to said pick-ups for generating electronic signals in response to string and structure vibration via said electronic pick-ups; and said structure body constituting an electrical ground for said electronic pick-ups.

7. The invention as defined in claim 6 wherein:

said high strength-to-weight ratio material is selected from metal having a molecular density equal to or greater than the molecular density of magnesium.

8. The invention as defined in claim 7 wherein:

said structure body and fret board are separate elements joined in overlapping relationship at their opposing edge marginal regions in an integral load bearing connection; and said connection comprising a plurality of steel dowel pins interconnecting said overlapped fret board and body edge marginal regions.

9. The invention as defined in claim 8 wherein:

said structure fret board includes a plurality of accurately spaced apart grooves occupied by a fret bar;

each of said grooves constituting a machined groove accurately spaced from adjacent grooves within 0.0005 of an inch.

10. The invention as defined in claim 9 wherein:

said overlapped fret board and body are within an overall combined thickness of equal to or less than one inch.

11. The invention as defined in claim 10 wherein:

said structure body and fret board are composed of a metal capable of being cast and plated which rigidizes said structure to enhance its vibratory memory characteristics.

* * * * *